US007685854B2

(12) United States Patent
Xu et al.

(10) Patent No.: US 7,685,854 B2
(45) Date of Patent: Mar. 30, 2010

(54) AXIAL SPRING BALANCING PIN TUMBLER LOCK

(76) Inventors: Forrest Xu, 1818 Fairgrove Ave., West Covina, CA (US) 91791; Daniel Xu, 1818 Fairgrove Ave., West Covina, CA (US) 91791

( * ) Notice: Subject to any disclaimer, the term of this patent is extended or adjusted under 35 U.S.C. 154(b) by 86 days.

(21) Appl. No.: 12/011,789

(22) Filed: Jan. 30, 2008

(65) Prior Publication Data

US 2009/0188287 A1 Jul. 30, 2009

(51) Int. Cl.
*E05B 27/08* (2006.01)

(52) U.S. Cl. ..... 70/491; 70/404; 70/419

(58) Field of Classification Search ..... 70/403, 70/404, 419, 491, 496
See application file for complete search history.

(56) References Cited

U.S. PATENT DOCUMENTS

| | | | | | |
|---|---|---|---|---|---|
| 2,024,030 | A | * | 12/1935 | Deutsch | 70/384 |
| 2,292,515 | A | * | 8/1942 | George | 70/491 |
| 3,267,706 | A | * | 8/1966 | Kerr | 70/491 |
| 3,524,335 | A | * | 8/1970 | George | 70/491 |
| 3,648,492 | A | * | 3/1972 | Walters et al. | 70/491 |
| 3,783,660 | A | * | 1/1974 | Gill | 70/491 |
| 3,797,289 | A | * | 3/1974 | Mercurio | 70/491 |
| 3,817,066 | A | * | 6/1974 | Pearson | 70/491 |
| 3,878,700 | A | * | 4/1975 | Lopez | 70/491 |
| 4,143,530 | A | * | 3/1979 | Murtezov et al. | 70/165 |
| 4,227,387 | A | * | 10/1980 | Steinbach | 70/491 |
| 4,507,945 | A | * | 4/1985 | Hwang | 70/491 |
| 4,546,629 | A | * | 10/1985 | Hwang | 70/491 |
| 4,653,297 | A | * | 3/1987 | Moorhouse | 70/491 |
| 4,683,739 | A | * | 8/1987 | Hughes | 70/365 |
| 5,163,310 | A | * | 11/1992 | Wang | 70/491 |
| 5,327,752 | A | * | 7/1994 | Myers et al. | 70/58 |
| 5,400,629 | A | * | 3/1995 | Myers | 70/491 |

* cited by examiner

*Primary Examiner*—Lloyd A Gall

(57) ABSTRACT

An axial spring balancing pin tumbler lock includes a cylindrical shell, a plug rotationally disposed within the shell and rotatable by a tubular key. The shell contains a plurality of first pin bores annularly and evenly defined to the axis of the shell for receiving first pins and first springs. The plug has a through aperture for engaging with a elongated spindle, a key bore coaxially defined on front end for receiving the tubular key, a plurality of third pin bores annularly and evenly defined on front end with same depth of the key bore for receiving third pins, and a plurality of second pin bores defined on rear end of the plug for receiving second pins and second springs. Each second pin may contacts the tubular key and one of third pins simultaneously. The extension force of the second spring at its preloaded length is stronger than that of the first spring at its fully loaded length so both second pin and third pin are urged by compound extension force to their most extended position while the first pin is at its most retracted position. The extended third pins bridge the shear plane of the lock, the plug is then blocked from rotating. Since the third pins are isolated from the opening keyway and are not driven by key notches or external force directly, the conventional lock picking or bumping methods must fail.

9 Claims, 6 Drawing Sheets

AXIAL SPRING BALANCING PIN TUMBLER LOCK

FILED OF THE INVENTION

The present invention relates to a locking device. More specifically, the present invention relates to an axial pin tumbler lock with unique pick-resistant mechanism that can not be easily unlocked by conventional lock picking or bumping approaches.

BACKGROUND OF THE INVENTION

The axial pin tumbler locks, also known as tubular locks or "Ace" locks, were invented in last century and have been developed for many years. The following U.S. patents are believed to represent the prior and current state of the art:

U.S. Pat. Nos. 4,112,820; 4,621,510, 4,802,354; 5,018, 376; 5,400,629; 5,544,512; 6,357,271 and 7,150,168.

As evidenced by these patents, a tubular lock generally includes a shell containing a plurality of first pin bores; a plug, rotatable within the shell, containing a plurality of second pin bores facing to the first pin bores on the shell; and a plurality of pin sets, each comprising a spring-loaded first pin and a second pin, in the prior state of the art. The locking mechanism is created by having each spring-loaded first pin that seated in the first pin bore on the shell extended into a corresponding second pin bore in the plug at their initial position so to span both the shell and the plug and block the plug from rotating. The second pins reside in the second pin bores in the plug for receiving and transferring external force and in turn moving their corresponding first pins away by a pre-determined distance from their initial position so to catch the shear plane between the shell and the plug. All second pins normally expose directly to the keyway with relatively bigger profile so that they are relatively easier to be accessed and manipulated by picking or bumping tools.

So far as we know, all the development tried to provide a relatively higher level of security within the prior state of the art of axial pin tumbler locking mechanism have not changed the core nature of double-pin-single-spring configuration. So the basic disadvantage of easily being picked open is not improved practically.

SUMMARY OF THE INVENTION

It is the primary object of the present invention to provide an axial pin tumbler lock with a new pin tumbler spring configuration that is highly resistant to lock picking or bumping attempt.

It is another related object of the present invention to provide an axial spring balancing pin tumbler lock that is generally cost efficient to manufacture.

It is a further related object of the present invention to provide an axial pin tumbler lock that is easy to be assembled, mastered and serviced.

The foregoing mentioned objects and other objects of the present invention are achieved by providing an exemplary axial spring balancing pin tumbler lock with a new and unique pin tumbler spring configuration that improves the locking mechanism of the prior art by changing the "initial-on-duty" locking pin tumblers to the combination pins from the driver pins in the prior art, changing the driven force that moves the "initial-on-duty" locking pin tumblers to pre-determined internal forces from external key forces in the prior art, changing the "initial-on-duty" pins to being isolated from being exposed directly to the opening keyway in the prior art. By all those new approaches and more, the axial spring balancing pin tumbler lock of the present invention makes it extremely difficult to unlock the lock by means of conventional lock picking or bumping methods.

Overall, the foregoing objects and other advantages of the present invention will become more apparent from the following detailed description when taking in conjunction with the reference drawings.

BRIEF DESCRIPTION OF THE DRAWINGS

The structure, features and functions of this invention are described in detail with reference to the following description together with the accompany drawings, in which.

DETAILED DESCRIPTION OF THE INVENTION

Figure 1:
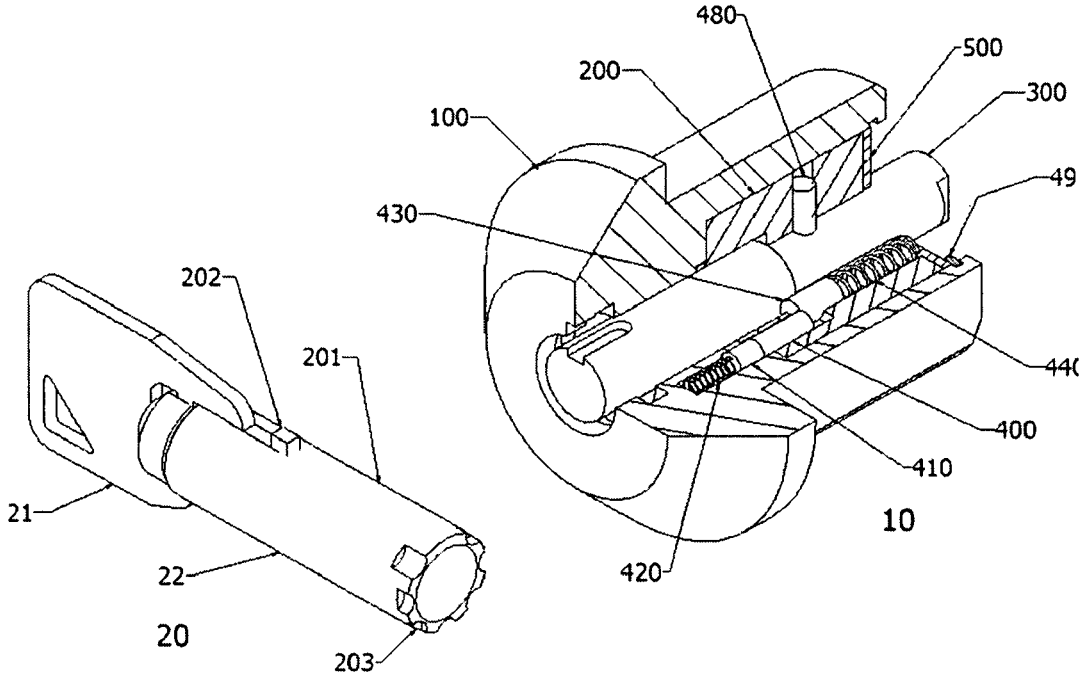
FIG. 1 is a perspective view, quarterly sectioned and broken away, of an exemplary axial spring balancing pin tumbler lock and a tubular key of the present invention.

With reference to FIG. 1, an exemplary lock in accordance with the present invention comprises an axial spring balancing pin tumbler lock 10 and a tubular key 20 corresponding to the lock 10.

Figure 2:
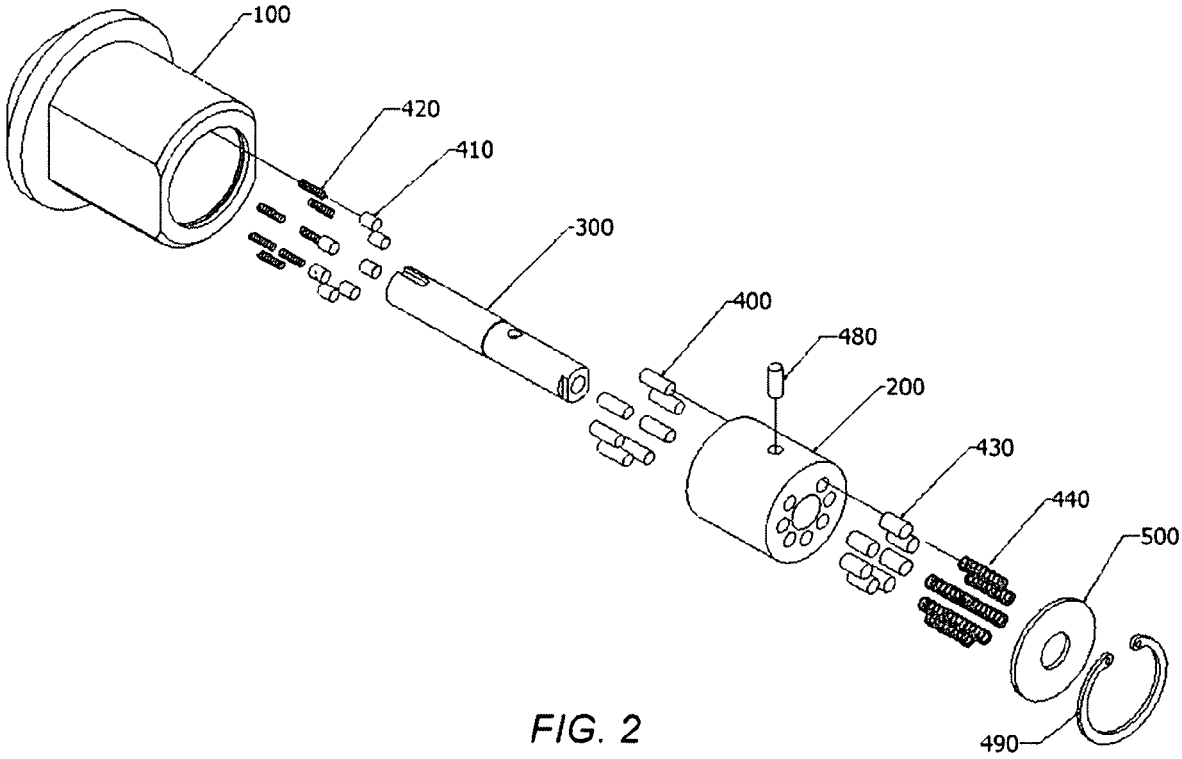
FIG. 2 is an exploded perspective of the lock in accordance with the present invention.

Referring to FIG. 2, the lock 10 comprises a shell 100; a plug 200, a spindle 300, a plurality of first pins 410 and first coiled compression spring 420, a plurality of second pins 430 and second coiled compression spring 440, a plurality of third pins 400, a retaining pin 480, a cover 500 and a retaining ring 490.

Figure 3A:
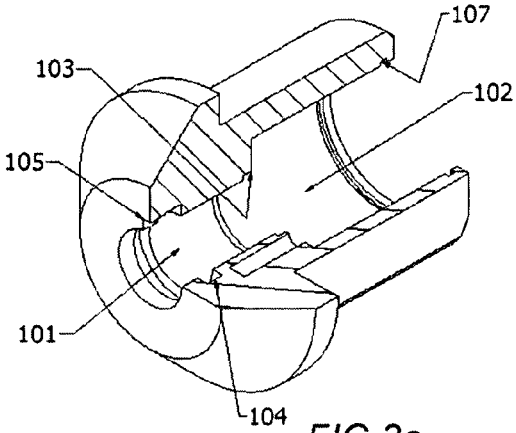
FIGS. 3*a* and 3*b* are isolated perspective views, quarterly sectioned and broken away and from different angle, of an exemplary housing used in the lock of the present invention.
Figure 3B:
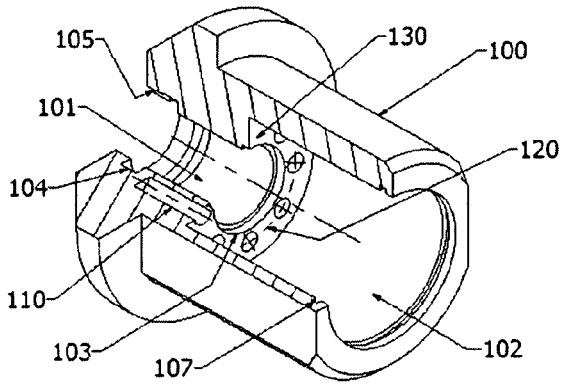
Figure 8:
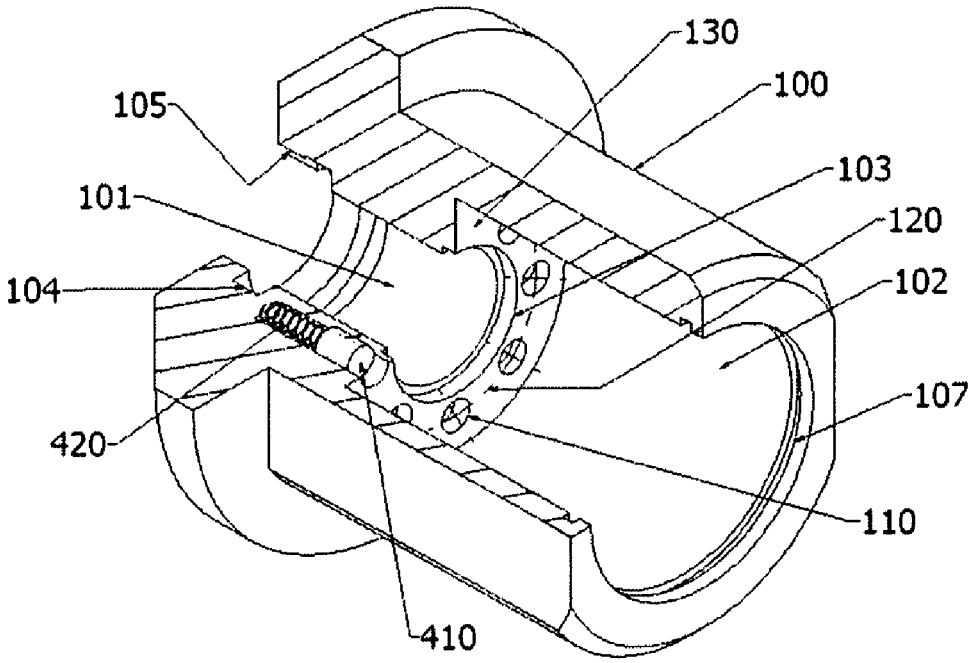
FIG. 8 is a perspective view, quarterly sectioned and broken away, of an exemplary housing sub-assembly used in the lock of the present invention.

Referring to FIGS. 3*a*, 3*b* and 8, the shell 100 comprises a through hole 101, a main bore 102 coaxially defined on rear end, a shallow bore 103 coaxially defined on bottom surface 130 of the main bore 102, a first annular groove 104 defined on the through hole 101 near the front end, a second annular groove 107 defined on the main bore 102 near the rear end, a keyway 105 defined on front end communicating to the first annular groove 104, and a plurality of first pin bores 110 defined annularly and evenly along a pitch circle 120 on the bottom surface 130 of the main bore 102. The first coiled compression springs 420 and first pins 410 are disposed into the first pin bores as shown in FIG. 8.

Figure 4A:
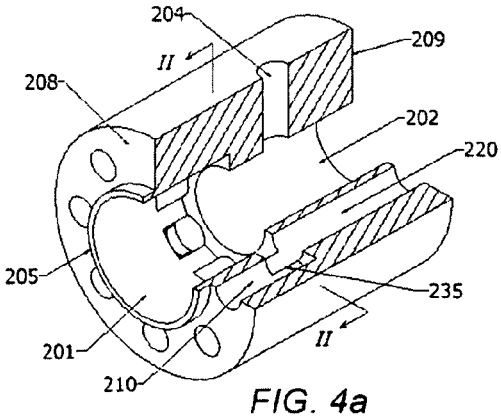
FIG. 4*a* is an isolated perspective view, quarterly sectioned and broken away, of an exemplary plug used in the lock of the present invention.
Figure 4B:
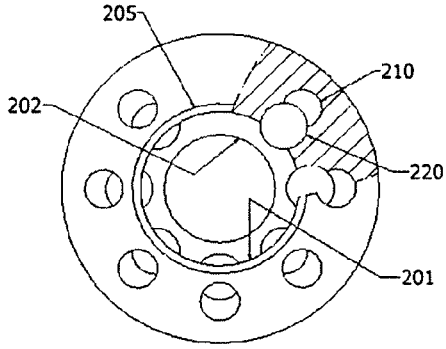
FIG. 4*b* is a front view, partially sectioned and broken away along line II-II of the same part in FIG. 4*a*.

Referring to FIGS. 4*a* and 4*b*, the plug 200 comprises a key bore 201 coaxially defined on front end 208, a through aperture 202, a locking pin hole 204 defined on outer cylindrical surface communicating to the through aperture 202, an annular collar 205 extended the key bore 201 on front end 208, a plurality of third pin bores 210 defined on the front end 208 with same depth of the key bore 201 and arranged such that each one of the third pin bores 210 extends coaxially with one of corresponding first pin bores 110 in the shell 100, a plurality of second pin bores 220, each is greater than the third pin bore 210 in diameter, defined annularly and evenly on the rear end 209 and arranged such that each one of the second pin bore 220 is radially and inwardly eccentric to its corresponding third pin bore 210 respectively and overlaps the key bore 201 and one of the corresponding third pin bores 210 radially and axially in the middle portion of the plug 200.

Figure 5:
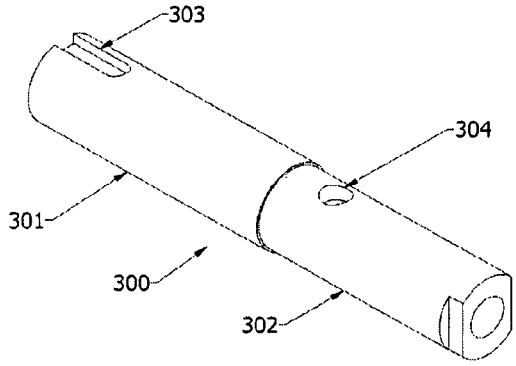
FIG. 5 is a perspective view of a spindle used in the lock of the present invention.
Figure 9:
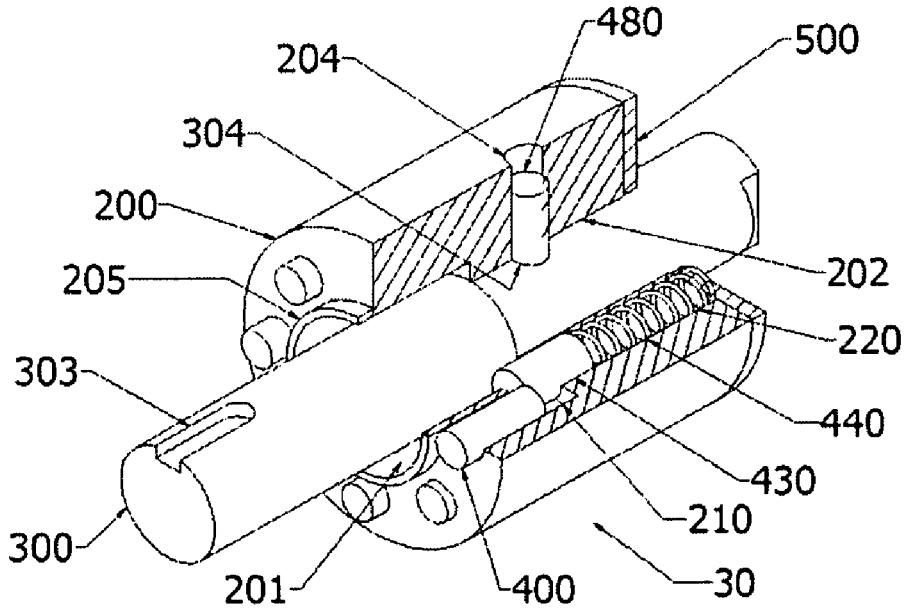
FIG. 9 is a perspective view, quarterly sectioned and broken away, of an exemplary plug sub-assembly used in the lock of the present invention.

With reference to FIGS. 5 and 9, an elongated spindle 300 comprises a front portion 301, a rear portion 302 with smaller diameter than the front portion 301, a short axial groove 303 defined on the front end and a cutout 304 defined on the rear portion. The spindle 300 is fixedly engaged with the through aperture 202 in the plug 200 and is secured by a retaining pin 480. The third pins 400 are disposed into the third pin bores 210 in the plug 200. The second pins 430 and second coiled compression springs 440 are disposed into the second pin bores 220 in the plug 200 as shown for receiving their corresponding third pins 400 and tubular key notches 203. The cover 500 fixedly attaches to the spindle 300 and abutted against the rear end 209 of the plug so to retain the second pins 430 and second coiled compression springs 440 within the second pin bores 220. The plug sub-assembly 30 is then disposed into the main bore 102 of the shell 100 in such way that the front end 208 of the plug 200 mating to the bottom surface 130 of the shell 100 and is retained by a internal retaining ring 490 so to prevent the plug sub-assembly 30 from moving outwardly.

Figure 10:
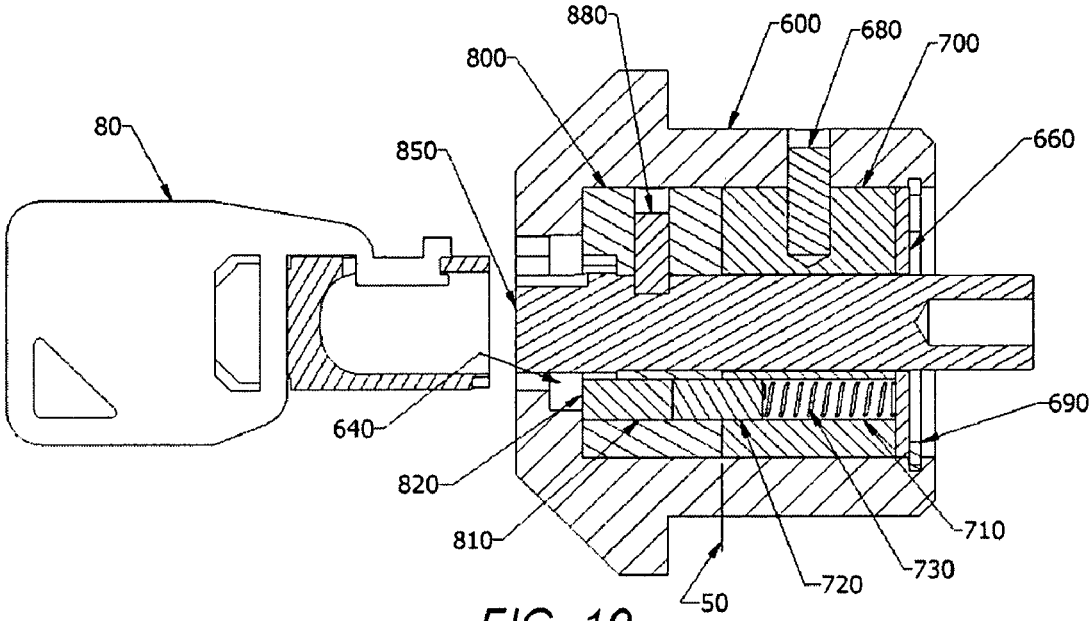
FIG. 10 is an axially sectioned view of an axial pin tumbler lock in the prior art.

Referring to FIGS. 1 and 10, the key 20 used in the present invention is quite similar to a tubular key 80 in the prior art except that the key 20 has an elongated tubular portion 201 between the lug 202 and the notches 203.

The through hole 101 in the shell 100 and the key bore 201 in the plug 200 have exactly the same diameter. The through hole 101, the key bore 201 and the spindle 300, when they are assembled, constitute a tubular keyway 40 for receiving tubular key 20.

Figure 6:
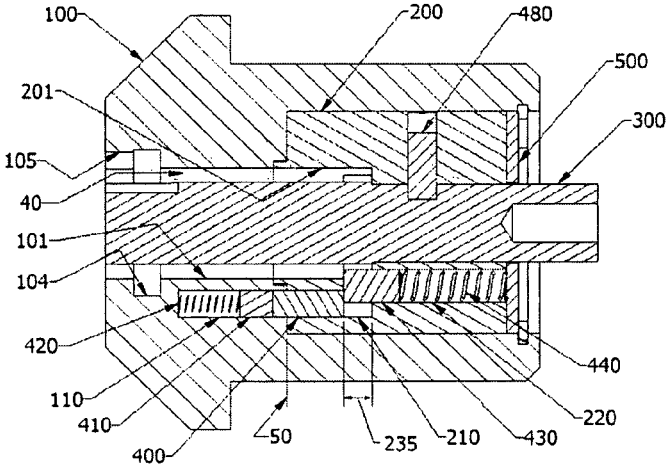
FIG. 6 is an axially sectioned view showing the locking mechanism of the present invention in case of no key engaged with the lock.
Figure 7:
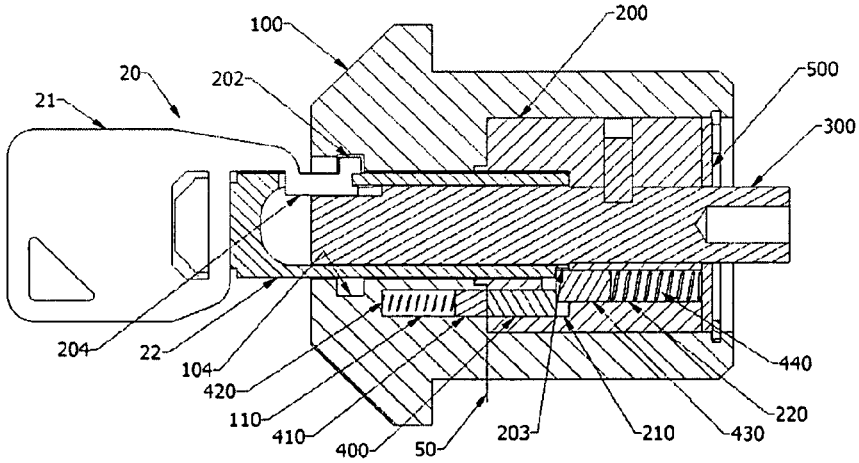
FIG. 7 is an axially sectioned view showing the unlocking mechanism of the present invention when a key with correct notches fully inserted into the keyway.
Figure 11:
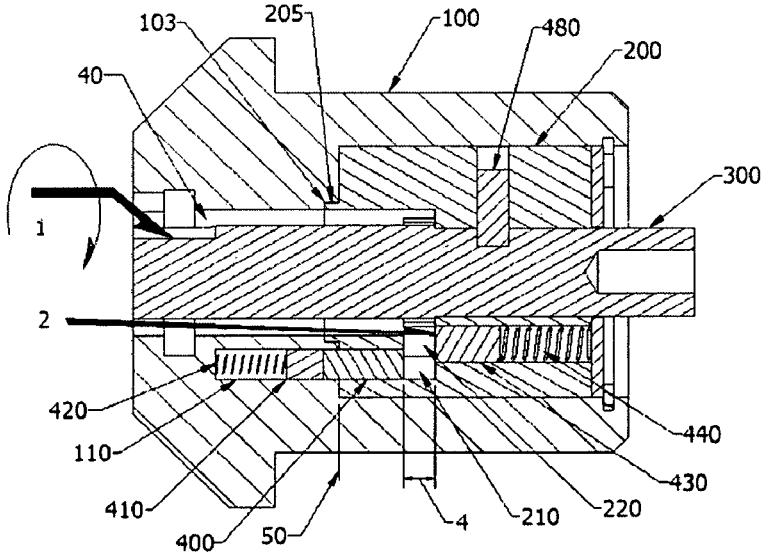
FIG. 11 is an axially sectioned view showing the picking resistant features of the present invention.

Referring to FIGS. 6, 7 and 11, the locking and unlocking mechanism of an exemplary axial spring balancing pin tumbler lock of the present invention is described further below.

As has been described in detail in above sections, an exemplary lock in accordance with the present invention utilizes a plurality of pin spring set, each comprising three pins 410, 400 and 430 that are sandwiched between a pair of coiled compression springs 420 and 440 along their pin bores 110, 210 and 220 respectively. Among those components, the third pin 400 and the first pin 410 have the same size in diameter so they can slide into each other resident pin bore in operation. The second pin 430 is greater than first pin 410 in diameter. The extension force of the second coiled compression spring 440 at its preloaded length is greater than that of the first coiled compression spring 420 at its fully loaded length. When there is no key engaged, all second pins 430 and third pins 400 are urged by the compound extension force of the first coiled compression springs 420 and the second coiled compression springs 440 to their most extended position while all first pins 410 are urged to their most retracted position. The third pins 400 are the combination pins of the locking mechanism so their lengths vary. The shortest third pin 400 is such long that its front end is flush to the front end 208 of the plug 200 when it is at its most extended position and the longest is such long that its front end is flush to the front end 208 of the plug 200 when it is at its most retracted position. The length varying range of the third pins 400 is defined by the axially overlapped distance 235 of the second pin bores 220 and the third pin bores 210 in the plug 200. The mating surface of the plug 200 and the shell 100 constitutes a shear plane 50 of the locking mechanism of the lock 10 of the present invention. When there is no key or external picking attempt engages, all or some of the third pins 400 extend into their corresponding first pin bores 110 in the shell 100. The extended third pins 400 bridge the shear plane 50, the plug 200 is therefore blocked from rotating.

FIG. 7 shows the unlocking mechanism of the present invention in case that a key 20 with an external key 202, an internal key 204 and the correct notches 203 fully inserted into the keyway 40. Each notch 203 with correct length properly depresses the second pin 430 away from its initial position and it, in turn, deforms the second coiled compression spring 440 to such a length that it just allows the front end of the third pin 400 to coincide with the shear plane 50 by the new compound extension force of the second coiled compression spring 440 and the first coiled compression spring 420, the plug 200 is therefore free to rotate within the shell 100.

If a key 20 with incorrect notches 203 is inserted into the keyway 40, the notches 203 and the extension force of the first coiled compression springs 420 cause the pins 430, 400 and 410 to move together to such new position that the front end of each third pin 400 is either fallen into the third pin bore 210 in the plug 200, thus its corresponding first pin 410 will bridge the shear plane 50, or is still remaining in the first pin bore 110 in the shell 100 then the third pin 400 will bridge the shear plane 50. No matter which scenario occurs, the plug 200 is blocked from rotating within the shell 100.

With regarding to the picking-resistant features that the present invention pertains, FIG. 10 to 11 illustrated how it works in some typical situation of conventional lock picking attempts.

As illustrated in FIG. 10, a conventional pin tumbler lock 60 typically contains only one group of coiled compression springs and two groups of pins. A group of first pins 720 and first coiled compression springs 730 reside in a group of first pin bores 710 in a stationary plug 700 which is fixedly anchored to the shell 600. A group of second pins 820 reside in a group of second pin bores 810 in a rotatable plug 800 and is partly exposed to the keyway 640. The first pins 720 are extended into their corresponding second pin bores 810 in the rotatable plug 800 so to bridge the shear plane 50 and block the rotatable plug 800 from rotating about the stationary plug 700. To pick a conventional axial pin tumbler lock, it needs to apply a rotation torque to the rotatable plug 800 first and to employ a picking tool to tentatively depress a selective second pin 820 and to find a skewed corresponding first pin 720, then further depress it down until getting a feeling that the other end of the second pin reaching the shear plane 50. This picking method in the prior art will not work on this new lock of the present invention.

As shown in FIG. 11, when a rotation torque 1 is applied to the spindle 300 then a picking tool 2 is inserted into the keyway 40 to depress one selected second pin 430 down as it normally does in the prior art for a picking attempt, the third pin 400 associated with the second pin 430 will be skewed by the misaligned bores 110 and 210 due to the inevitable tolerance among the components at its initial position. Depressing or hitting the contacting second pin 430 further by a pick or bumping tool 2 through the keyway 40 will cause the second pin 430 to be separated from its mating third pin 400 and a gap 4 will be produced. Since the third pin 400 is isolated from the keyway 40, there is no way to pull or push the third pin 400 moving back to the third pin bore 210 except with the extension force of the first coiled compression spring 420. However, that force is too small to overcome the pin skewing friction. A sudden release of the rotation torque 1 may help the skewed third pin 400 moving, but the moving distance is not controllable, and the picking or bumping attempts must fail.

As shown in FIG. 11, an exemplary lock of the present invention has a coupling arrangement: an annular collar 205 defined on front end 208 of the plug 200 mates a shallow bore 103 coaxially defined on the bottom surface 130 of the main bore 102 in the shell 100. This structure constitutes two straight angle turns about the tubular keyway 40 so to prevent the third pins 400 from being accessed or measured by a picking tool.

We claim:

1. An axial spring balancing pin tumbler lock comprising:

a shell having a through hole, a main bore defined on the rear end and a plurality of first pin bores defined annularly and evenly on the bottom surface of the main bore;

a plug having a through aperture and a key bore coaxially defined on the front end, whereas a plurality of third pin bores being defined on the front end with same depth of the key bore and arranged such that each one of the third pin bores extends coaxially with one of corresponding first pin bores in the shell;

whereas a plurality of second pin bores being defined annularly and evenly on the rear end and arranged such that each one of the second pin bores is radially and inwardly eccentric to its corresponding third pin bore;

whereas each one of the second pin bores radially and axially overlapping the key bore and one of the corresponding third pin bores simultaneously;

whereas the plug being disposed into the main bore of the shell;

a spindle having a short axial groove defined on the front end and being fixedly engaged with the through aperture in the plug;

a plurality of first coiled compression springs and first pins being disposed into the first pin bores in the shell;

a plurality of second pins and second coiled compression springs being disposed into the second pin bores in the plug;

a plurality of third pins being disposed into the third pin bores in the plug.

2. The axial spring balancing pin tumbler lock according to claim 1 wherein the second pin bores are greater than the third pin bores in diameter.

3. The axial spring balancing pin tumbler lock according to claim 1 wherein the second pins is greater than the third pins in diameter.

4. The axial spring balancing pin tumbler lock according to claim 1 wherein the extension force of the second coiled compression springs at their preloaded length being stronger than the extension force of the first coiled compression springs at their fully loaded length.

5. The axial spring balancing pin tumbler lock according to claim 1 wherein an annular collar coaxially defined on the front end of the plug mates a shallow bore coaxially defined on the bottom surface of the main bore in the shell so to prevent the third pins from being accessed by a picking tool.

6. The axial spring balancing pin tumbler lock according to claim 1 wherein the length of the third pins varies that the shortest is such long that its front end is flush to the front end of the plug when it is at its most extended position and the longest is such long that its front end is flush to the front end of the plug when it is at its most retracted position.

7. The axial spring balancing pin tumbler lock according to claim 1 wherein the shell further comprises a first annular groove defined on the through hole approximate to the front end, a second annular groove defined on the main bore near the rear end and a keyway defined on the front end communicating to the first annular groove.

8. The axial spring balancing pin tumbler lock according to claim 1 wherein a cover being fixedly attached to the spindle and abutted against the rear end of the plug so to retain the second pins and second coiled compression springs within the second pin bores in the plug.

9. The axial spring balancing pin tumbler lock according to claim 7 wherein a internal retaining ring is disposed into the second annular groove to prevent the plug from moving outwardly.

* * * * *